United States Patent [19]

Rocha

[11] 4,065,998

[45] Jan. 3, 1978

[54] GUN LOCK AND FIRING MECHANISM FOR 30MM CANNON

[75] Inventor: John G. Rocha, Davenport, Iowa

[73] Assignee: The United States of America as represented by the Secretary of the Army, Washington, D.C.

[21] Appl. No.: 701,490

[22] Filed: June 30, 1976

[51] Int. Cl.[2] ..... F41D 7/02

[52] U.S. Cl. ..... 89/11; 89/132

[58] Field of Search ..... 42/15, 39.5; 89/1.801, 89/1.805, 1.815, 9, 11, 17, 33 MC, 155

[56] References Cited

U.S. PATENT DOCUMENTS

| | | | |
|---|---|---|---|
| 3,474,560 | 10/1969 | Ramsay | 42/15 |
| 3,548,709 | 12/1970 | Prince | 89/9 |

*Primary Examiner*—Stephen C. Bentley

*Attorney, Agent, or Firm*—Nathan Edelberg; Harold H. Card, Jr.; Robert O. Richardson

[57] ABSTRACT

A firing chamber lock and unlock mechanism for automatic large caliber weapons having a reciprocable firing chamber and rotatable cam means for both actuation of the locking and unlocking functions and actuation of the reciprocation of the firing chamber synchronized to the firing cycle requirements of the weapon system.

15 Claims, 6 Drawing Figures

4
10
2
6
72
30
60
12
62
64
8
16
26
14
50
18
54
48
56
58
19
24
28
20
32
40
38
46
44
42
69
68
22
2
I
I

GUN LOCK AND FIRING MECHANISM FOR 30MM CANNON

GOVERNMENT RIGHTS

The invention described herein may be manufactured and/or used by or for the Government for governmental purposes without the payment of any royalty thereon.

BACKGROUND OF THE INVENTION

In rapid fire large caliber automatic weapons systems in general the firing chambers are fixed stationarily with respect to the receiver. The lock mechanism for locking the cartridge in the firing chamber has been categorized as either sliding lock mechanisms or rotating lock mechanisms. Sliding lock and rotating lock mechanisms have required considerable energy expenditure for movement thereof. In the sliding lock case, friction contributed to the energy requirements, and, in the rotating lock case, the size of the lock, not only presented energy and inertia problems, but also increased the receiver size requirements.

Another problem common to these two locking mechanisms was that the head space tolerances of the firing chamber imposed additional requirements in the design of the lock mechanisms.

The foregoing problems also existed with weapon systems of the reciprocating firing chamber type as well as problems of locking and unlocking timing functions coordinated to the firing cycle of the weapon.

Reciprocating firing chambers, in addition to the locking problems, also presented problems of synchronization of the movement of the firing chamber between the in and out of battery positions with the firing cycle demands of the weapon system.

SUMMARY OF THE INVENTION

With the present invention, the foregoing problems, difficulties, and disadvantages of the prior art, among others, are substantially overcome by the provision of a new and unobvious locking mechanism for an automatic weapon system having a reciprocable firing chamber and new and unobvious means for actuating reciprocation of the firing chamber synchronized to the firing cycle requirements of the weapon system including a gun lock and firing control system 2 having a reciprocable firing chamber 8 movably carrying the gun bolt 12 and firing mechanism 14 from between an in battery firing and an out of battery position. A unidirectionally rotatable and externally driven outer casing 16 has a cylindrical cam raceway 19 for a cam follower 24 carried by the firing chamber 8 to reciprocate the firing chamber, bolt and firing mechanism linearly between the in battery and out of battery positions.

The stationary receiver 6 includes a pivotable firing chamber lock member 68 which is actuatable by a cam surface 80 on the rotatable outer casing 6 to lock the firing chamber in its in battery firing position. A projection 76 carried by the lock member 68 depresses the movable cocked sear 62, after locking of the firing chamber in its firing position, thereby releasing the firing pin 60 to fire the weapon.

After firing of the weapon, the lock cam surface lug 80 on the outer casing pivots the lock member 68 to its unlocked position. Meanwhile, the cam follower 24 of the firing chamber continues to move in its raceway 19 in the outer casing 16 and begins to return the firing chamber 8 rearwardly to its out of battery position. During its movement rearwardly over the then stationary bolt, the firing chamber 8 engages a movable crosspin 32 carried by the bolt which, in moving rearwardly with the firing chamber 8, not only moves the bolt a short distance to its out of battery position, but also cocks the firing mechanism 14 by depressing the striker spring 50. When the striker 48 reaches its rearmost position, the spring biased sear 62 detents into an aperture 66 in the bolt 12 to keep the striker cocked and latch the bolt and firing mechanism together for movement to the in battery position.

The striker, bolt and stationary receiver are in rotational alignment by means of an aligner pin 42. When the firing chamber comes to rest momentarily in its out of battery position, the outer casing, in rotating, begins to move the firing chamber forward to its in battery firing position. The end wall 28 of the firing chamber engages a shoulder 30 on the bolt so that the bolt and latched firing mechanism are carried then by the firing chamber to their in battery firing positions. The lock cam surface 80 of the outer casing again engages the lock member 68 and pivots it to the locked position behind the firing chamber, and the projection 76 on the lock member 68 depresses the sear 62 and releases the striker for another round firing. Continued rotation of the outer casing cam 80 moves the lock member out of the locking position to permit return movement again of the firing chamber, bolt and firing mechanism to their out of battery positions, cocking and latching of the firing mechanism and latching of the firing mechanism to the bolt for return to the in battery position.

This repetition of the firing cycle will continue as long as the external drive of the system continues to rotate the outer casing.

DESCRIPTION OF THE DRAWINGS

The foregoing and other features, objects and advantages of the present invention will become readily apparent to one skilled in the art from a reading of the following description of a preferred embodiment of the present invention, when read in conjunction with the accompanying drawing, wherein like reference numerals refer to like and corresponding parts throughout the several views, and wherein.

DESCRIPTION OF THE PREFERRED EMBODIMENT

Figure 1:
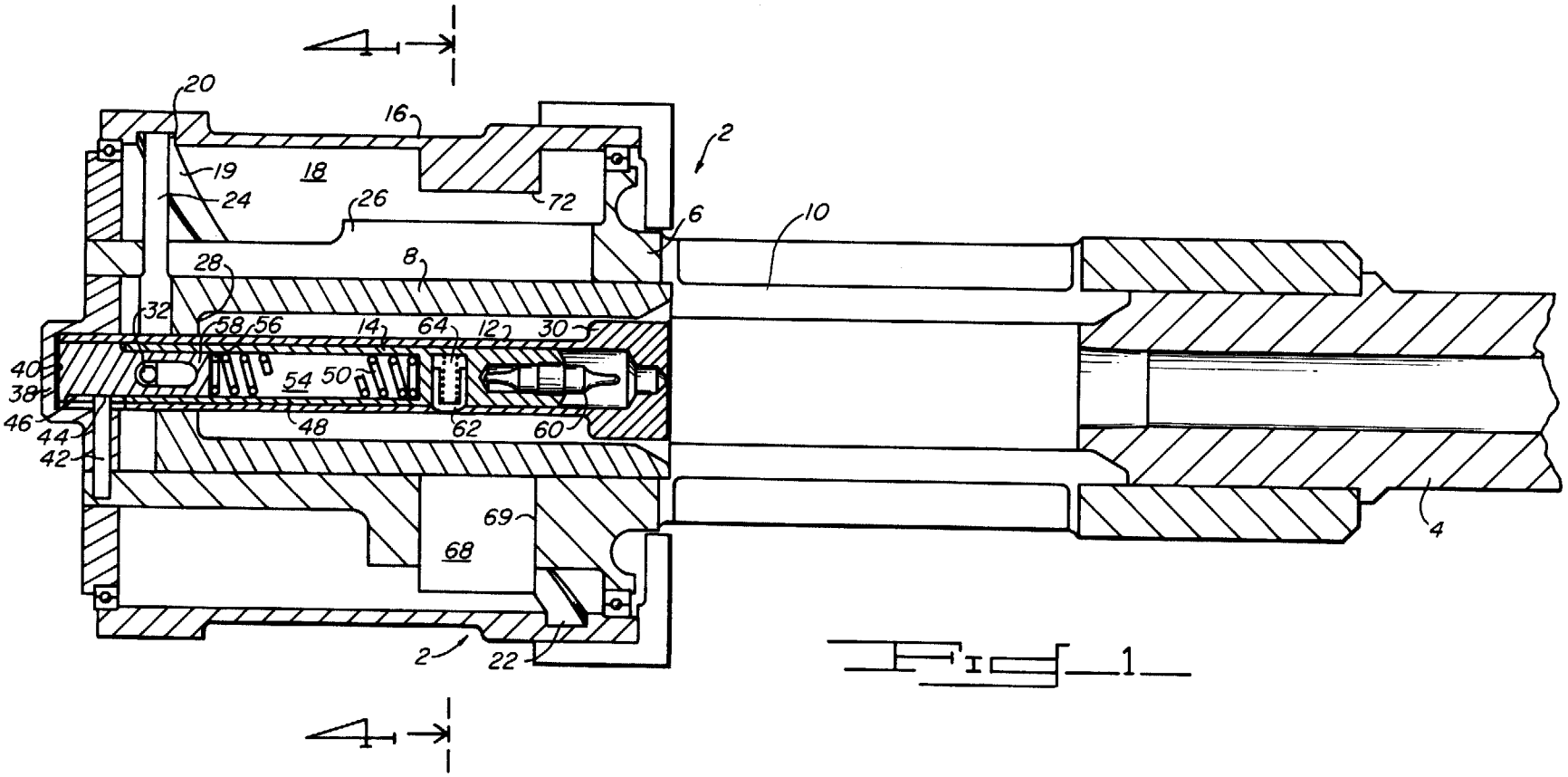
FIG. 1 is a view in section illustrating a weapon system incorporating the present invention with the firing chamber, bolt and firing mechanism in the out of battery position.

An automatic weapon system 2 is illustrated in FIG. 1 in the out of battery position and includes a barrel 4, a stationary receiver 6, a coaxial reciprocable firing chamber 8, ammunition feed section 10, a coaxial reciprocable bolt 12, a coaxial reciprocable firing mechanism 14 and a unidirectionally rotatable outer casing 16 which is concentric and coaxial with, and, in the out of battery position of the firing chamber, circumscribes the receiver 6, the firing chamber 8, bolt 12 and firing mechanism 14. Means (not shown) are provided to rotate the outer casing 16.

To cause reciprocation of the firing chamber 8 between the out of battery position (FIG. 1) and the in battery position (FIG. 2), the inner surface 18 of the outer casing is provided with an arcuate continuous cylindrical cam groove or raceway 19 which extends from one end 20 of the casing 16 to the other end 22. The reciprocable firing chamber 8 carries at its breech end a laterally disposed cam follower 24 which extends through an elongated slot 26 formed in the receiver 6 (FIG. 3) and rides in the raceway 19. The slot 26 also acts as a guide to prevent rotary movement of the firing chamber 8 during reciprocation thereof.

Movement of the bolt 12 with the firing chamber 8 into the in battery position (FIG. 2) from the out of battery position (FIG. 1) results from the engagement of the end wall 28 of the firing chamber 8 with an enlarged annular head 30 on the bolt 12, just prior to the firing chamber 8 entering its final in battery position.

Figure 6:
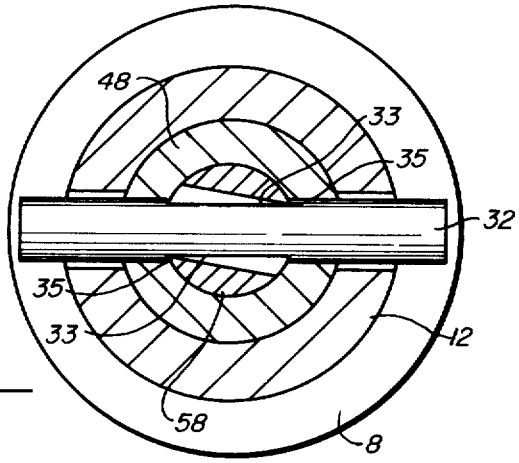
FIG. 6 is a cross sectional view illustrating the firing mechanism cocking device.

Movement of the bolt 12 with the firing chamber 8 from the in battery position (FIG. 2) to the out-of-battery position (FIG. 1) occurs as follows. As the cam follower 24 reciprocates to the left, as viewed in FIG. 2, it moves the firing chamber 8 toward the rear which then slides over the bolt 12 towards its out of battery position. Near the end of its rearward movement to its out of battery position, the end of the firing chamber 8 engages a cross pin 32 which extends through the firing mechanism and which rides in slots 34 and 36 (FIG. 6) formed in the bolt 12. As seen in FIG. 6, the cross pin 32 has centrally located shouldered cut out portions 33 which are engageable by the ends 35 of a bolt plug 58. The bolt plug 58 is sized to provide a loose tolerance with the bolt stem 12 whereby movement of the cross pin 32 in either horizontal direction is prevented by engagement of the ends 35 of the plug 58. An aligning pin 42 is provided to assure the cross pin cut outs 33 are aligned properly with the plug 58. When the cross pin 32 contacts the left hand side of the bolt slots it moves the bolt into its out of battery position. To provide a rear guide surface and spacing for the bolt movement, the end plate 38 is provided with a recess 40 best seen in FIG. 2. An anti-rotation aligning pin 42 for the bolt is fixedly carried at one end by the receiver 6 so that its other end 44 rides in a slot 46 formed in the bolt.

The firing mechanism 14 includes a striker body 48, and an internal striker actuating spring 50 bottomed against the end wall 52 of the striker recess 54 and at its other end 56 against a plug 58 fixedly carried by the bolt 12. A firing pin 60 is carried by the striker 48. To complete the firing mechanism, a spring biased sear plunger 62 is transversely located in a recess 64 formed in the striker 48.

The firing mechanism is cocked during the rearward movement of the firing chamber into the out of battery position. Because the cross pin 32 is carried by the striker body (FIG. 6), rearward movement of the bolt and crosspin 32 under the influence of the firing chamber 8 causes rearward movement (FIG. 1) of the striker body 48 thereby compressing the striker spring 50. When the striker body 48 is in the cocked position (FIG. 2), the transverse spring biased sear plunger 62 enters a stepped aperture 66 (FIGS. 2, 4, and 5) formed in the bolt 12 to latch the bolt and firing mechanism for movement together to the in battery position. Automatic means, to be described hereinafter, is employed to unlatch the sear 62 and permit firing of the firing mechanism, when the firing chamber, bolt and firing mechanism are locked in the in-battery position.

The firing chamber locking mechanism comprises two members; a transversely pivotable lock and unlock lever member or arm 68 carried by the stationary receiver and a cam surface 80 on the interior of the rotatable outer casing 16.

Figure 4:
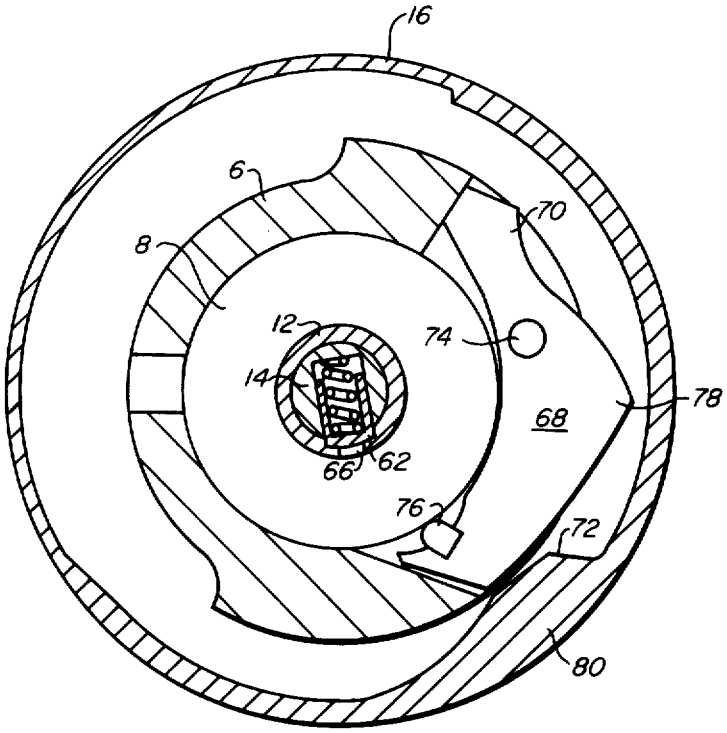
FIG. 4 is a view taken along line 4—4 of FIG. 1.
Figure 5:
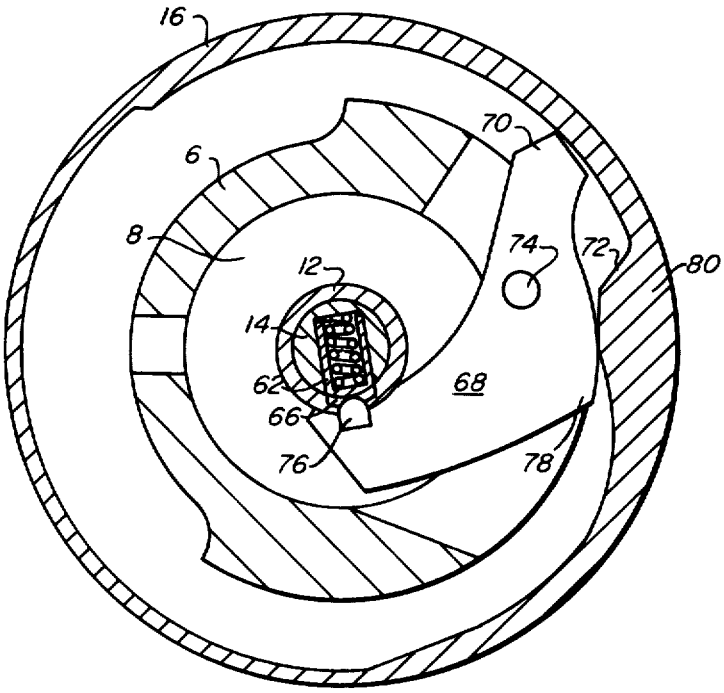
FIG. 5 is a view taken along line 5—5 of FIG. 2.

The transverse lever member 68, in the embodiment shown in the drawing, pivots in a recess 69 in the receiver (FIGS. 1, 2, 4, and 5) and is formed to provide a firing chamber contact locking surface portion (FIGS. 4 and 5) which, in the locking position, engages behind the firing chamber 8 (FIG. 5). At its opposite end, the lever 68 has an offset projection which forms an unlocking lug 70 engageable by the cam surface 72 to move the lever 68 from the locking position (FIG. 5) pivotally about the pivot pin 74 to the unlocking position to permit movement of the firing chamber to the out of battery position, as programmed by the cam track in the outer casing.

The lever arm 68 also carries a projection 76 (FIGS. 2, 4, and 5) which is located so as to enter the bolt aperture 66 and displace the sear 62 therefrom to unlatch the striker spring 50 to actuate movement of the striker 48 and thus the firing pin 60 to fire a round only after the level arm 68 has been positioned in its locking position (FIG. 5).

The lever arm 68 is contoured to provide a substantially arcuate protrusion 78 which is engageable by the cam lug 80 carried by the movable outer casing 16, sequentially (a) to pivot the lever 68 transversely to the lock position when the firing chamber is in the in-battery position, (b) to hold the lever 68 in the lock position during firing of the weapon, (c) to initiate movement of the lever 68 to the unlock position and, (d) to pivot the lever out of the path of travel of the firing chamber 8 returning to the out of battery position. It will be appreciated that the engaging surfaces of the lever 68 and cam 80 are contoured relative to each other, and that the rate of rotation of the outer casing relative to the movements of the firing chamber, bolt and firing mechanism are synchronized to perform the firing cycle programmed for the weapon system.

Figure 2:
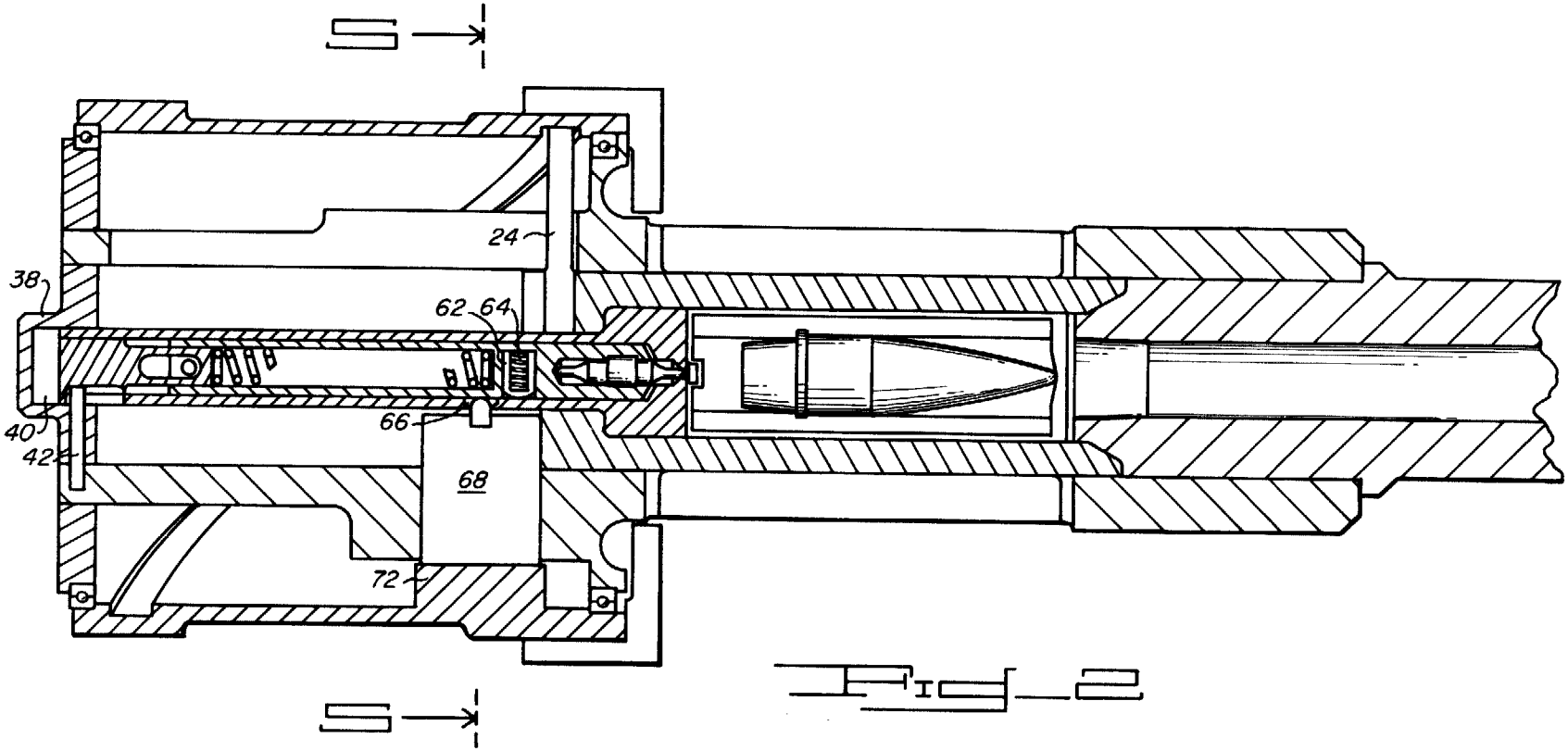
FIG. 2 is a view in section of the system of FIG. 1 with the firing chamber, bolt and firing mechanism in the in battery position.
Figure 3:
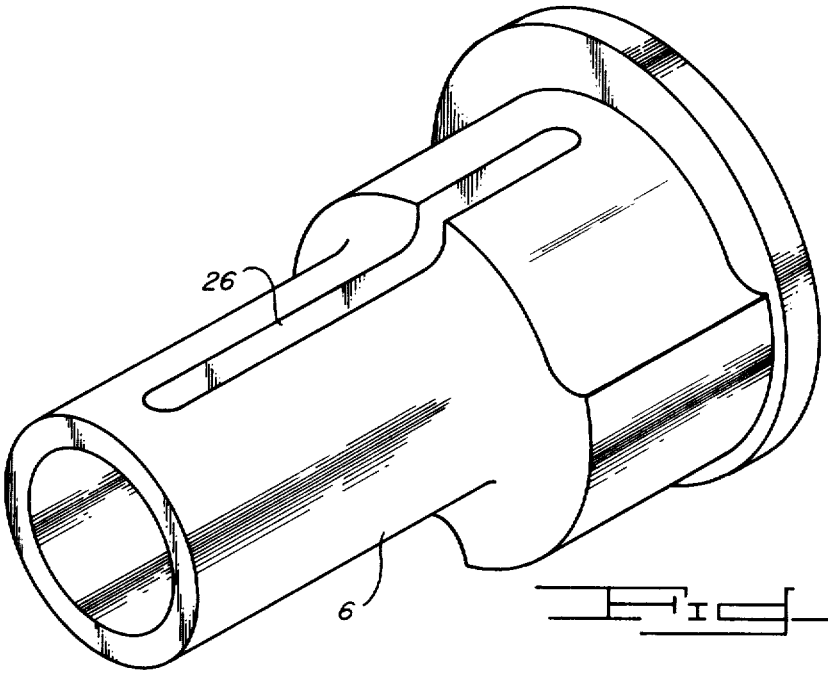
FIG. 3 is a perspective view of the receiver of the system of FIG. 1.

In operation, assuming the firing chamber, bolt and firing mechanism with the firing pin cocked are in the out of battery position (FIG. 1) and the locking lever 68 is in its unlocked position (FIG. 4), the rotating outer casing 16 causes linear movement of the cam follower 24 in the raceway 19 and along the receiver slot 26. Such movement of the cam follower 24 causes movement of the firing chamber 8 towards the in-battery position (FIG. 2).

As the firing chamber approaches its in battery position, its internal end wall 28 engages the head 30 of the bolt 12 and moves the bolt to its in battery position. Because the sear 62 is engaged in the recess 66 of the bolt 12, the cocked firing mechanism 14 is also moved with the bolt and firing chamber to the in-battery position.

After the linearly moving parts have reached their in-battery positions, the lock cam 80 carried by the outer casing 16 engages the lever 68 and pivots the lever into its locked position behind the firing chamber and the projection 76 then depresses the sear 62. The striker 48 is thus released, thereby firing the weapon.

Because of the predetermined design configurations of the cam surface 72 of the unlocking lug 70, a sufficient dwell time is programmed into the coaction between surface 72 and lug 70 to permit firing of the weapon and movement of the lever 68 from the locked position (FIG. 5) and, after firing, to permit return movement of the firing chamber, bolt and firing mechanism to the out of battery position.

Continued rotation of the cam 80 causes engagement of surface 72 with unlocking lug 70. Such contact and continued rotation of cam surface 72 causes the lever 68 to pivot counterclockwise about pin 74 and moves the lever 68 from the locked position (FIG. 5) to the unlocked position (FIG. 4). Pivoting of the lever 68 also removes the lever projection 76 from the hole 66. After the lever 68 is returned to its unlocked position, continued rotation of the outer casing and movement of cam follower 24 causes rearward movement of the firing chamber which slides over the bolt to the out of battery position. As the firing chamber nears the end of its rearward movement, it engages cross pin 32 and moves the bolt 12 to its out of battery position. Because cross pin 32 is also carried by the firing mechanism 14, rearward movement of the cross pin moves the firing mechanism rearwardly and cocks the firing mechanism. The firing mechanism is cocked when sear 62, moving relative to the bolt, enters the stepped hole 66 in the bolt to latch the firing mechanism to the bolt in the cocked position ready for movement together in the next firing cycle to the in battery position.

After the firing chamber, bolt and cocked firing mechanism are returned to their out of battery positions, the continued rotation of the outer casing and coaction of the cylindrical cam 19 and cam follower 24 initiate a new weapon firing cycle by returning the firing chamber, bolt and cocked firing mechanism to the in battery position.

It will be appreciated that new unidirectional rotatable actuator means for reciprocating a linearly movable firing chamber of an automatic weapon system between in and out of battery positions is provided by the present invention.

In addition, new and improved means for coordinating and synchronizing movement of the movable bolt and firing mechanism with movement of the firing chamber between the in and out of battery positions is also provided by the present invention.

Furthermore, new and improved automatic and positive means for locking and unlocking the firing chamber, bolt and firing mechanism are provided by the present invention, such means also being coordinated and synchronized with the position of the firing chamber to perform the locking and unlocking functions.

Moreover, automatic cocking and uncocking means are provided for the firing mechanism synchronized with the movement characteristics of the firing chamber, bolt and firing mechanism.

It is to be understood that, while only a single embodiment of the present invention has been shown and described, many variations and improvements will become readily apparent to one skilled in the art, and that this invention is only limited by the scope of the following claims.

I claim:

1. In a weapons system including a stationary receiver, a reciprocable firing chamber, a reciprocable bolt and a reciprocable firing mechanism having in and out of battery positions, the improvement comprising:

means for reciprocating said firing chamber between said positions, means carried by the receiver for locking the firing chamber in the in-battery position, means carried by the firing chamber to move the bolt between said positions and to secure the bolt in the in-battery position, means carried by the bolt to move the firing mechanism between said positions and to secure the firing mechanism, when cocked, in the in-battery position, means carried by the firing chamber locking mechanism for automatically initiating release of said cocked firing mechanism to fire a round when said firing chamber is in said in-battery position and, means for latching and unlatching said locking means in response to the relative position of said firing chamber.

2. The system of claim 1 wherein said means for reciprocating said firing chamber includes:

an outer casing concentric with the path of movement of said firing chamber, a cylindrical cam raceway in the interior surface of said outer casing, and a cam follower carried by said firing chamber in said raceway to impart linear reciprocable movement to said firing chamber between said positions in response to rotation of said outer casing, and means for permitting only unidirectionally rotation of said outer casing relative to said firing chamber.

3. The system of claim 2 wherein said stationary receiver is substantially cylindrical and includes a rectilinear slot through whch said cam follower extends, said slot guiding said cam follower during its movement between said positions and preventing rotation of said firing chamber.

4. The system of claim 3 including an alignment means fixedly carried by said receiver for preventing rotation of said bolt and firing mechanism relative to said firing chamber.

5. The system of claim 4 wherein said alignment means comprises a pin extending laterally from said receiver and into a recess in said bolt to permit linear movement of said bolt within the limits prescribed by the length of the recess.

6. The system of claim 4 wherein said firing mechanism is movable in said bolt and includes:

an elongated body portion carrying a firing pin striker at one end, spring means in a recess in said striker body portion, said spring means being bottomed at one end against said bolt to bias the striker and firing pin to their firing position, and crosspin means extending laterally through an aperture in said body portion of said firing mechanism and through said slot in said bolt, said crosspin means being engageable by said firing chamber during linear movement of the firing chamber to its out of battery position to move the striker and firing pin linearly relative to the bolt to their cocked position against the bias of said spring means.

7. The system of claim 6 including sear means carried by the firing mechanism and means carried by the bolt to releasably latch the firing mechanism in its cocked position and to the bolt for movement therewith.

8. The system of claim 7 wherein said sear means comprises a transverse outwardly biased plunger and said bolt latch means includes an aperture for receiving said plunger to hold the firing mechanism in its cocked position and to the bolt for movement therewith.

9. The system of claim 7 wherein said reciprocable firing chamber includes a wall defining an internal shoulder for engagement with a projection on the bolt to move the bolt and firing mechanism to the in-battery position.

10. The system of claim 2 wherein said locking mechanism comprises a transversely pivotable lever member carried by the receiver having a first position for locking the firing chamber in its in-battery firing position and a second unlocking position for permitting reciprocable movement of the firing chamber.

11. The system of claim 10 wherein the outer casing carries means for camming the pivotable lever member into its first and second positions sequentially in response to the position of the firing chamber.

12. The system of claim 11 wherein the lever member carries sear release means to release the sear and thereby release the cocked firing pin, when the lever member is in the locked position.

13. The system of claim 12 wherein the lever member include an unlocking lug engageable by said lock camming means to move the lever member from the locked to the unlocked position.

14. The system of claim 13 wherein the lock camming means also moves the sear release means from the path of movement of the firing mechanism with respect to the bolt.

15. In a weapon system including a stationary receiver, a reciprocable firing chamber, a reciprocable bolt and a reciprocable firing mechanism having in and out of battery positions, the improvement comprising:

a firing chamber reciprocating and lock actuation mechanism for locking the firing chamber, bolt, and firing mechanism in the in-battery position, said reciprocating the lock mechanism including an outer rotatable casing having a cylindrical cam raceway, a cam follower extending through a slot in the receiver and fixedly carried by the firing chamber for movement in said raceway to reciprocate said firing chamber, bolt, and firing mechanism between said positions, a cam surface carried by said outer casing for actuating locking of said firing chamber, bolt and firing mechanism in the in-battery position, a transverse lock member pivotably carried by said receiver and movable between locking and unlocking position behind said firing chamber in response to engagement thereof by said cam surface, means carried by the bolt for cocking said cam surface, and latching the bolt and firing mechanism together for movement to the in battery position and, means carried by the lock member to actuate the firing mechanism after the firing chamber, bolt and firing mechanism are locked in the in-battery position.

* * * * *